US005725404A

United States Patent [19]

Gomez

[11] Patent Number: 5,725,404

[45] Date of Patent: Mar. 10, 1998

[54] FLOATING BED ASSEMBLY

[76] Inventor: Jesus Gomez, 6034 SW. 27 St., Miami, Fla. 33155

[21] Appl. No.: 712,032

[22] Filed: Sep. 11, 1996

[51] Int. Cl.[6] ..... B63B 35/74

[52] U.S. Cl. ..... 441/130; 441/129

[58] Field of Search ..... 441/129–132, 441/40; 472/129; 114/61; 440/31

[56] References Cited

U.S. PATENT DOCUMENTS 3,771,181 11/1973 Dansereau ..... 114/39.1
3,802,366 4/1974 Mankawich ..... 114/61
5,090,695 2/1992 Ciolino ..... 441/129
5,299,588 4/1994 MacLeod ..... 441/130
5,324,221 6/1994 Kaufman et al. ..... 472/129

*Primary Examiner*—Sherman Basinger
*Attorney, Agent, or Firm*—J. Sanchelima

[57] ABSTRACT

A floating device that includes a floating member that is cooperatively designed to provide floating support to the lumbar portion of a user's body, a floating member for the legs and a floating member for the head. Elongated rigid members adjustably interconnect the floating members depending on user's height. A shade member is suspended above the head floating member and includes a telescopically adjustable support member.

5 Claims, 1 Drawing Sheet

FLOATING BED ASSEMBLY

BACKGROUND OF THE INVENTION

1. Field of the Invention

The present invention relates to a floating bed assembly.

2. Description of the Related Art Many floating devices have been designed in the past. Very popular among these floating devices are the lounge chairs that substantially keep the user above the water. The present invention, on the other hand, maintains a user afloat and the user is substantially immersed in the water with complete freedom of his or her limbs.

SUMMARY OF THE INVENTION

It is one of the main objects of the present invention to provide a device that is used to float in the water while a user lies down on her/his back.

It is another object of this invention to provide a device that is telescopically adjusted and adapted to the size of a user's body.

It is still another object of the present invention to provide a device that includes independent floating members removably interconnected which are easy to store and transport.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 is an isometric view of a floating bed assembly.

DETAILED DESCRIPTION OF THE PREFERRED EMBODIMENT

Figure 3:
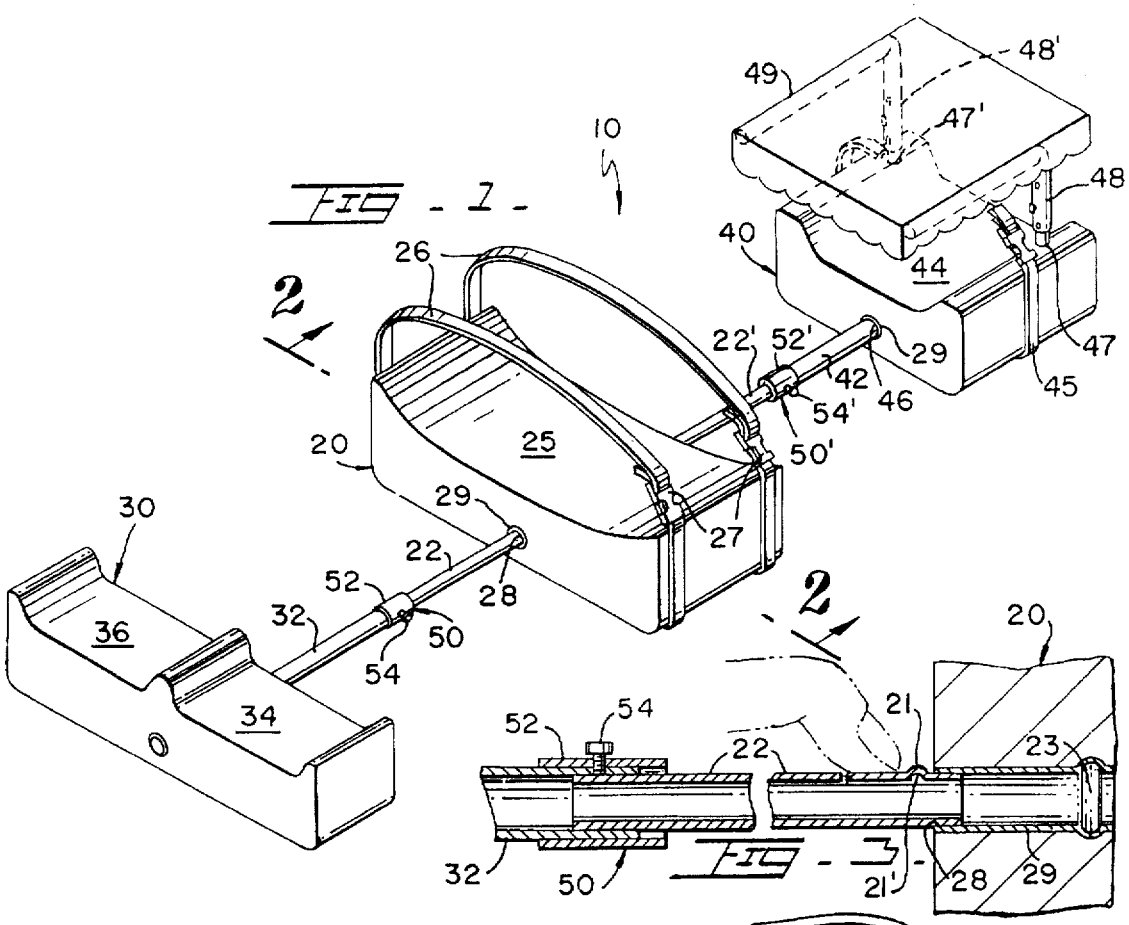
FIG. 3 is an enlarged partial cross sectional view of a floating member with a connecting tubular member mounted thereto.
Figure 2:
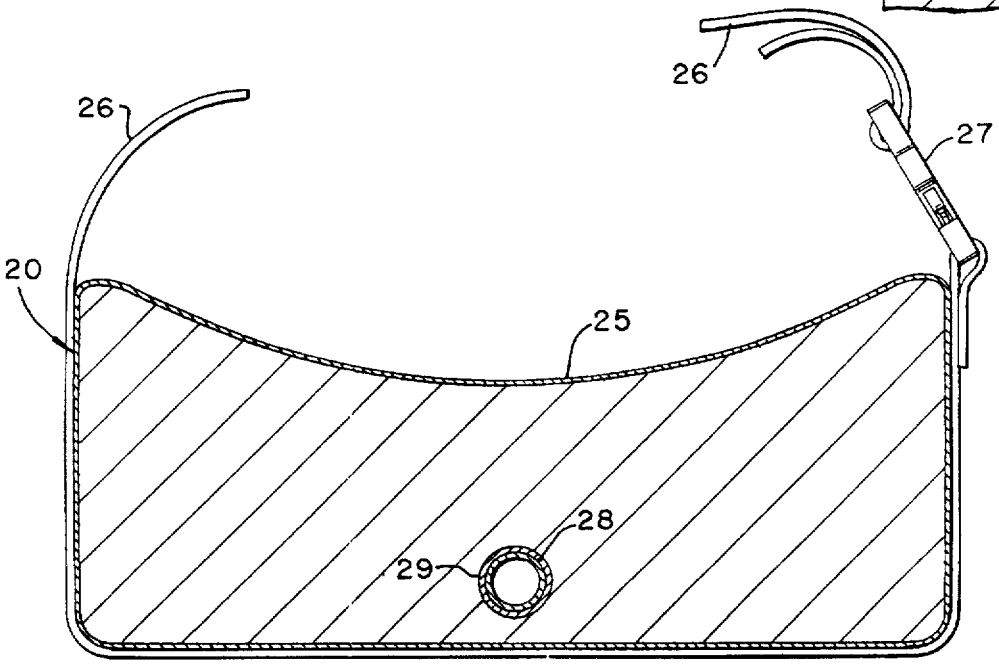
FIG. 2 is a cross section of an elevational view of the main floating member (lumbar portion) of the floating bed assembly, taken along line 2—2.

Referring now to FIG. 1, the present invention is generally referred to with numeral 10, and it can be observed that it basically includes floating members 20; 30 and 40 interconnected to each other by rigid tubular members 22; 22'; 32 and 42. Floating members 20; 30 and 40, in the preferred embodiment, form the floating support for a user in a body of water. Floating member 20 is the main floating member that corresponds to the lumbar portion of the human body. Floating member 20 includes belts 26 rigidly mounted thereto. Belts 26 have buckle members 27 designed to secure the user to member 20. A resting area for that part of the user's body is defined by surface 25. Openings 28 are centrally located adjacent to lowermost wall of member 20 and permits members 22 and 22' to penetrate inside member 20.

Floating member 30 provides floating support to the feet and includes basically two resting areas defined by surfaces 34 and 36. Surfaces 34 and 36 support the user's thighs, legs, or feet as desired. Floating member 30 has an opening (not shown in the drawings) where one end of tubular member 32 is inserted.

Floating member 40 provides floating support to the head floating member and has resting surface 44 to support user's head and/or neck. Floating member 40 is connected to floating member 20 through tubular member 42 that is mounted to floating member 40 through opening 46. Floating member 40 includes belt 45 to secure the user's head to resting surface 44, if desired. Floating member 40 also includes openings 47 and 47' to cooperatively receive members 48 and 48'. Tubular members 48 and 48', as seen in FIG. 1, support shade member 49 at a predetermined distance from surface 44. Members 48 and 48' are telescopically adjusted. Shade member 49 is designed to block the sun light to the user's eyes.

As mentioned above, floating members 20; 30; and 40 are interconnected to each other by members 22; 22'; 32 and 42. Members 22 and 32 are telescopically mounted to each other and locked to each other by fastening assemblies 50. Fastening assemblies 50 and 50', in the preferred embodiment, comprise connecting tubular members 52 and 52' and screw members 54 and 54', respectively. One of the ends of members 22; 22'; 32 and 42 are inserted within connecting tubular members 52 and 52' and secured in place by screw members 54 and 54', respectively. Tubular members 32 and 42 have larger diameter than members 22 and 22', thereby permitting the latter ones to be inserted within members 32 and 42 a desired distance.

As shown in FIG. 3, floating member 20 has tubular sheath 29 inside opening 28. Member 22 includes latch member 21. Latch member 21 locks member 22 to floating member 20 when the protuberance 21' of latch member 21 is trapped within annular receiving recess 23. A user applies a force to depress latch member 21 and simultaneously pushing member 22 in. Annular receiving recess 23 has a diameter large enough to cooperatively receive protuberance 21'. To release member 22, a user pulls with sufficient force to cammingly dislodge protuberance 21' from annular recess 23. A similar structure applies to floating members 30 and 40, and members 32 and 42.

Floating members 20; 30 or 40 can be used by itself or in combination and, are readily disassembled and to stored in minimum storage space. Floating members 20; 30 and 40 are made out of a floating material. They can be coated with a water-repellent paint or a plastic case or film.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A means device for supporting a user over a body of water, comprising:

A) first floating means having an upperside with a substantially concave surface for corresponding to and cooperatively supporting the lumbar portion of a user;

B) second floating means having an upperside with a sufficiently large area to support a user's feet; and C) third floating means having an upperside with a sufficiently large area to support a user's head, and further including elongated rigid means for connecting said first and third floating means passing through said second floating means.

2. The floating device as set forth in claim 1, wherein said elongated rigid means is telescopically adjustable.

3. The floating device set forth in claim 1, further including:

D) a shade member mounted to said third floating means at a cooperative spaced apart relationship thereto so that a user's head can be positioned therebetween to block the sun.

4. The floating device set forth in claim 3, wherein said shade member includes telescopic means for adjusting the separation of said shade member from said third floating means.

5. The floating device set forth in claim 4, wherein said first floating includes belt means for securing.

* * * * *